US005690267A

United States Patent [19]

Yang

[11] Patent Number: 5,690,267

[45] Date of Patent: Nov. 25, 1997

[54] MOUNTING STRUCTURE FOR STAPLE GUNS

[75] Inventor: Brad Yang, Taichung-Hsien, Taiwan

[73] Assignee: Testo Industry Corporation, Taipei, Taiwan

[21] Appl. No.: 663,972

[22] Filed: Jun. 14, 1996

[51] Int. Cl.[6] ..... B25C 1/04; B25C 5/13

[52] U.S. Cl. ..... 227/130; 227/156

[58] Field of Search ..... 227/130, 156, 227/8

[56] References Cited

U.S. PATENT DOCUMENTS

| | | | |
|---|---|---|---|
| 4,609,135 | 9/1986 | Elliesen | 227/130 |
| 4,932,480 | 6/1990 | Golsh | 227/130 |
| 5,062,562 | 11/1991 | Michael | 227/130 |
| 5,131,579 | 7/1992 | Okushima et al. | 227/130 |
| 5,207,143 | 5/1993 | Monacelli | 227/130 |
| 5,217,153 | 6/1993 | Yamamoto et al. | 227/130 |
| 5,441,192 | 8/1995 | Sugita et al. | 227/130 |
| 5,485,946 | 1/1996 | Jankel | 227/130 |

*Primary Examiner*—Joseph J. Hail, III
*Assistant Examiner*—Jay A. Stelacone
*Attorney, Agent, or Firm*—Beveridge, DeGrandi, Weilacher & Young, L.L.P

[57] ABSTRACT

An improved mounting structure for staple guns includes a plastic sleeve fitted around a cylinder of the staple gun for dividing an air chamber into an upper air chamber and a lower chamber. The plastic sleeve is comprised of a metal plate and a plastic body and may be fitted between two raised rings on the cylinder. Due to the plasticity of the plastic sleeve, the plastic sleeve may firmly adhere to the inner wall of the air chamber and the cylinder may be firmly positioned therein.

3 Claims, 5 Drawing Sheets

MOUNTING STRUCTURE FOR STAPLE GUNS

BACKGROUND OF THE INVENTION

1. Field of the Invention

The present invention relates generally to a mounting structure for staple guns, and more particularly to a mounting structure which is simple in construction and may firmly secure a cylinder in an air chamber of the staple gun. Besides, the mounting structure may be easy to assembly or dismantled to facilitate repairs and maintenance.

2. Description of the Prior Art

The structure of a conventional pneumatic staple gun is shown in FIG. 1. The staple gun is essentially comprised of an integrally molded gun body A, an air chamber A1 at an upper end of the gun body A, a top cover A2 for sealing the air chamber A1, and a cylinder C accommodated within an interior of the air chamber A1. A sleeve D1 is fitted on a raised ring C1 on the cylinder C, and a snap ring D2 is retained in a groove A11 on an inner wall of the air chamber A1. By means of the snap ring D2 which presses against the sleeve D1, and by means of the engagement of the sleeve D1 and the raised ring C1 of the cylinder C, the cylinder C may be secured in the air chamber A1. The sleeve D1 is further fitted with an O-ring D11 on the outside so that the sleeve D1 may be in close contact with the inner wall of the air chamber A1, dividing the air chamber A1 into an upper air chamber B1 and a lower air chamber B2. The upper air chamber B1 is provided to work in conjunction with a guide means G inside the top cover A2 so that the compressed air inside may instantly enter the cylinder C to push a strike pin E1 of a piston rod E accommodated within the cylinder C to send out a nail (not shown). A plastic buffer F is fitted at a rear end of the cylinder C for maintaining air-tightness at the openings of the air chamber A1 and the cylinder C. When the piston rod E pushes out the nail, the compressed air inside the lower air chamber B2 may enter via a plurality of air vents C2 circumferentially disposed around the cylinder C adjacent to the buffer F into the cylinder C to push the piston rod E back to its original position, completing the striking operation.

As can be seen from the above, the cylinder C cannot be firmly secured since the snap ring D2 is used to press against the sleeve D1 to keep the cylinder C in position. Furthermore, the sleeve D1 has to be provided with a groove to receive the O-ring D11 for dividing the air chamber into an upper air chamber and a lower air chamber. The construction is complicated and costly. Assembly and maintenance are also difficult.

SUMMARY OF THE INVENTION

Accordingly, a primary object of the present invention is to provide an improved mounting structure for staple guns which is simple in construction, easy to assemble and dismantle and firmly secures the cylinder of the staple gun inside the air chamber, thus eliminating the drawbacks associated with the prior art.

To achieve the above-mentioned object, the improved mounting structure of the present invention essentially comprises a plastic sleeve fitted between two raised rings on the outer surface of a cylinder of the staple gun. The plastic sleeve including a soft plastic body enveloping a metal plate is fitted around a cylinder. Due to the plasticity and softness of the plastic sleeve, the plastic sleeve may tightly adhere to an inner wall of a air chamber to firmly secure the cylinder inside the air chamber and divide the air chamber into an upper air chamber and a lower air chamber.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 3:
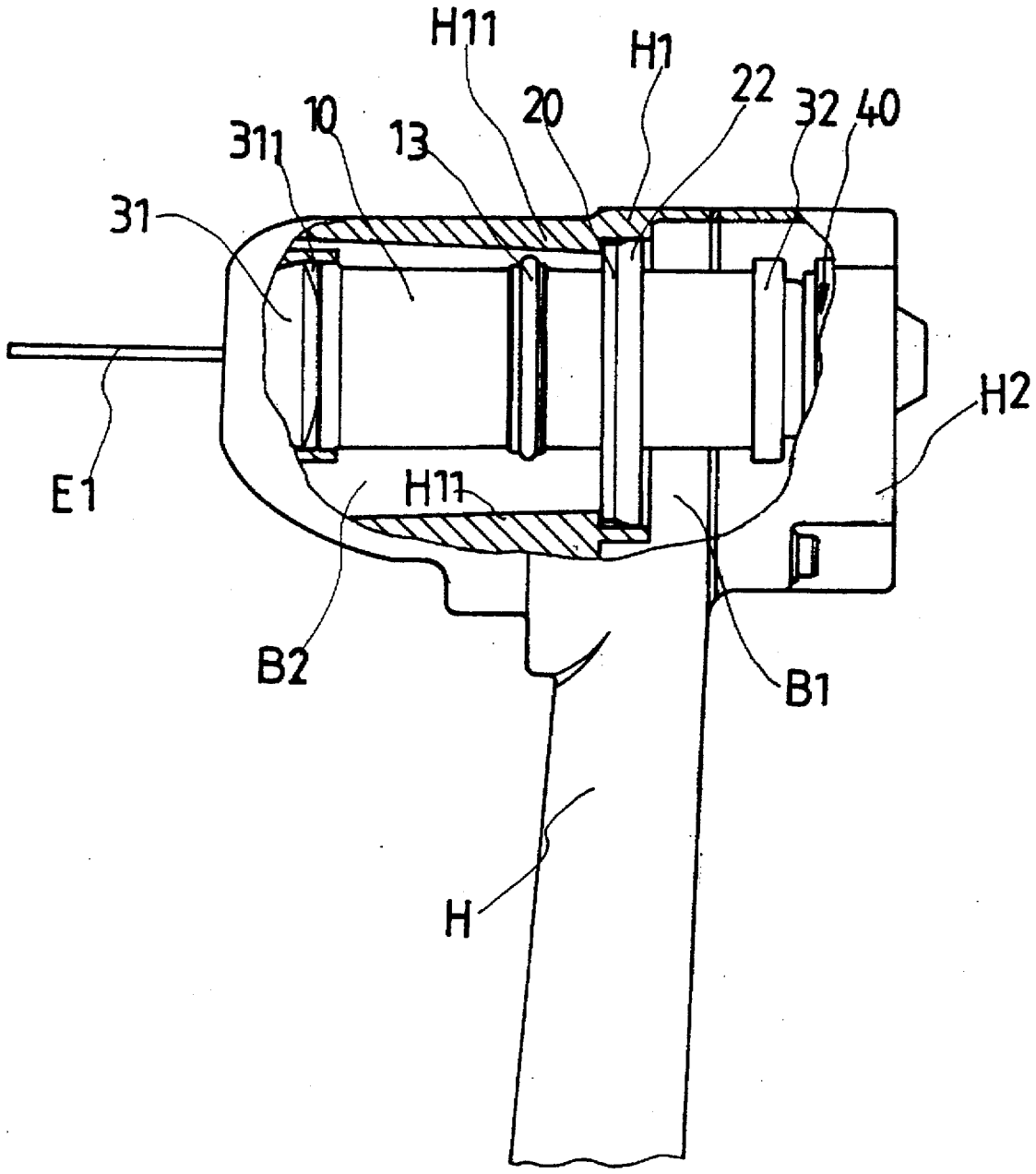
FIG. 3 is a schematic view of the preferred embodiment of the present invention in an assembled state.
Figure 4:
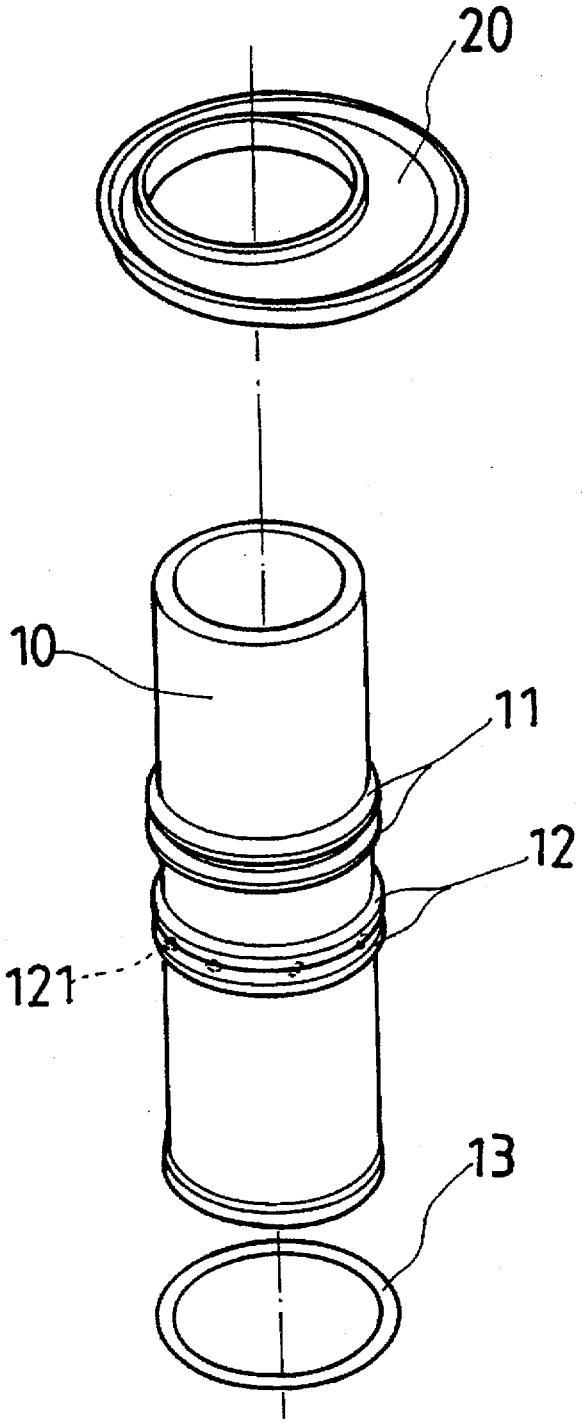
FIG. 4 is a schematic view of the mounting structure according to the present invention.

With reference to FIG. 3, a preferred embodiment of an improved mounting structure for staple guns of the present invention essentially comprises a cylinder 10, a soft plastic sleeve 20 fitted around the cylinder 10, a buffer 31 fitted at a bottom end of the cylinder 10, and a press element 32 fitted onto a top end of the cylinder 10 and working in cooperation with a guide means 40 for controlling the cylinder. With reference to FIG. 4, the cylinder 10 is an upright, hollow cylindrical structure. Its middle section is provided with two flanged rings 11 which are spaced a suitable distance apart from each other. The flanged rings 11 are provided for mounting the plastic sleeve 20. Two raised rings 12 are disposed on the cylinder 10 below the flanged rings 11 and are also spaced a suitable distance apart from each other. The inner edges of the raised rings 12 are provided with air vents 121. An O-ring 13 is fitted between the two raised rings 12 for sealing the air vents 121. Such an arrangement may provide a lower air chamber B2 with a unidirectional supply of air during return strokes of a piston rod E so as to push the piston rod E to return to its original position.

Figure 5:
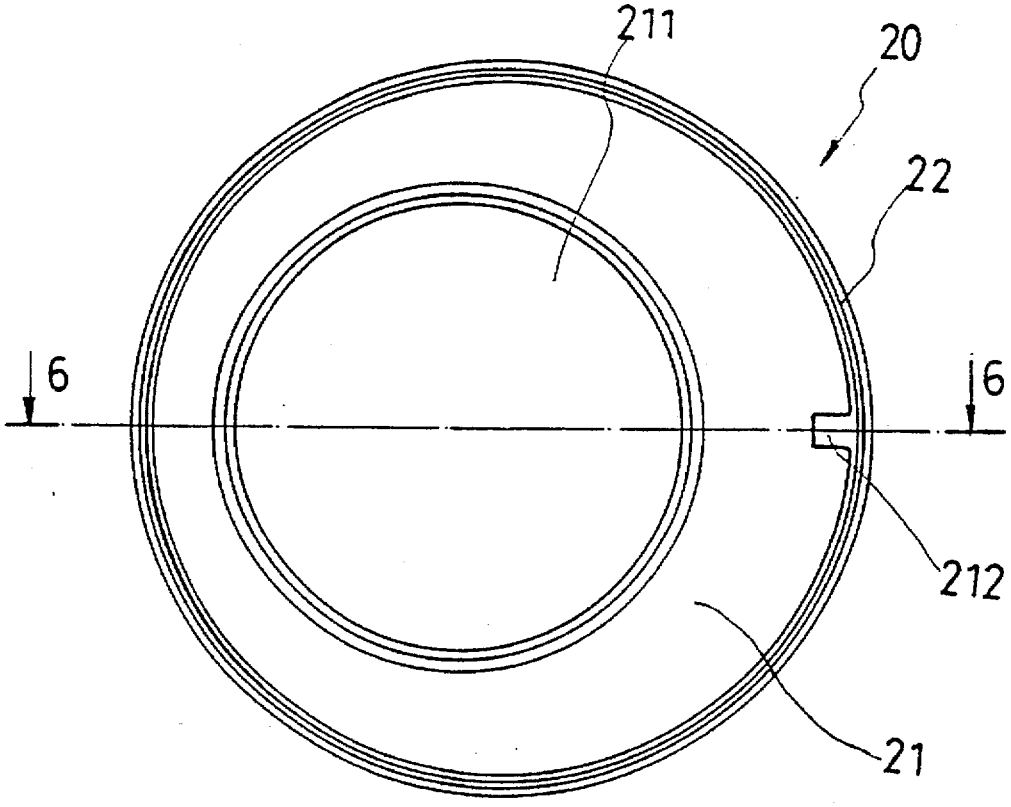
FIG. 5 is a schematic view of the plastic sleeve according to the present invention.
Figure 6:
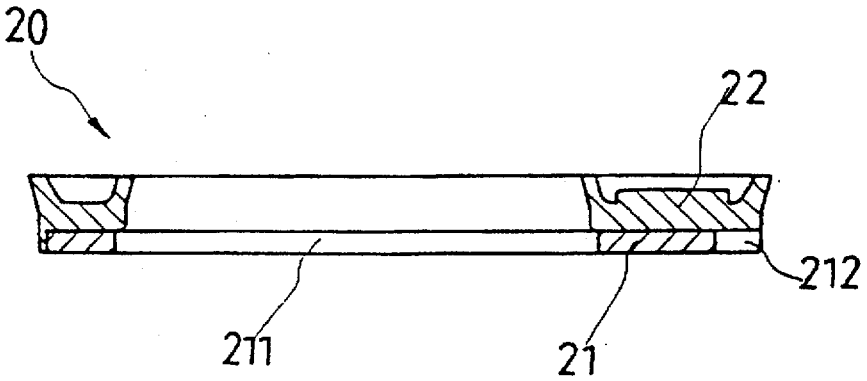
FIG. 6 is a sectional view of the plastic sleeve according to the present invention.

Referring to FIGS. 4, 5 and 6, the plastic sleeve 20 has a metal plate 21 as its structural body. A ring 211 is formed on the surface of the metal plate 21 for insertion of the cylinder 10. The position of the ring 211 may be determined by the actual structure of an air chamber H1 of the staple gun. A notch 212 is formed at an outer peripheral portion of the metal plate 21 for retaining a plastic body 22 when the metal ring 21 and the plastic body 22 are coupled together to enhance their connection. When the plastic sleeve 20 is being formed, the plastic body 22 may completely envelop the metal plate 21.

Figure 1:
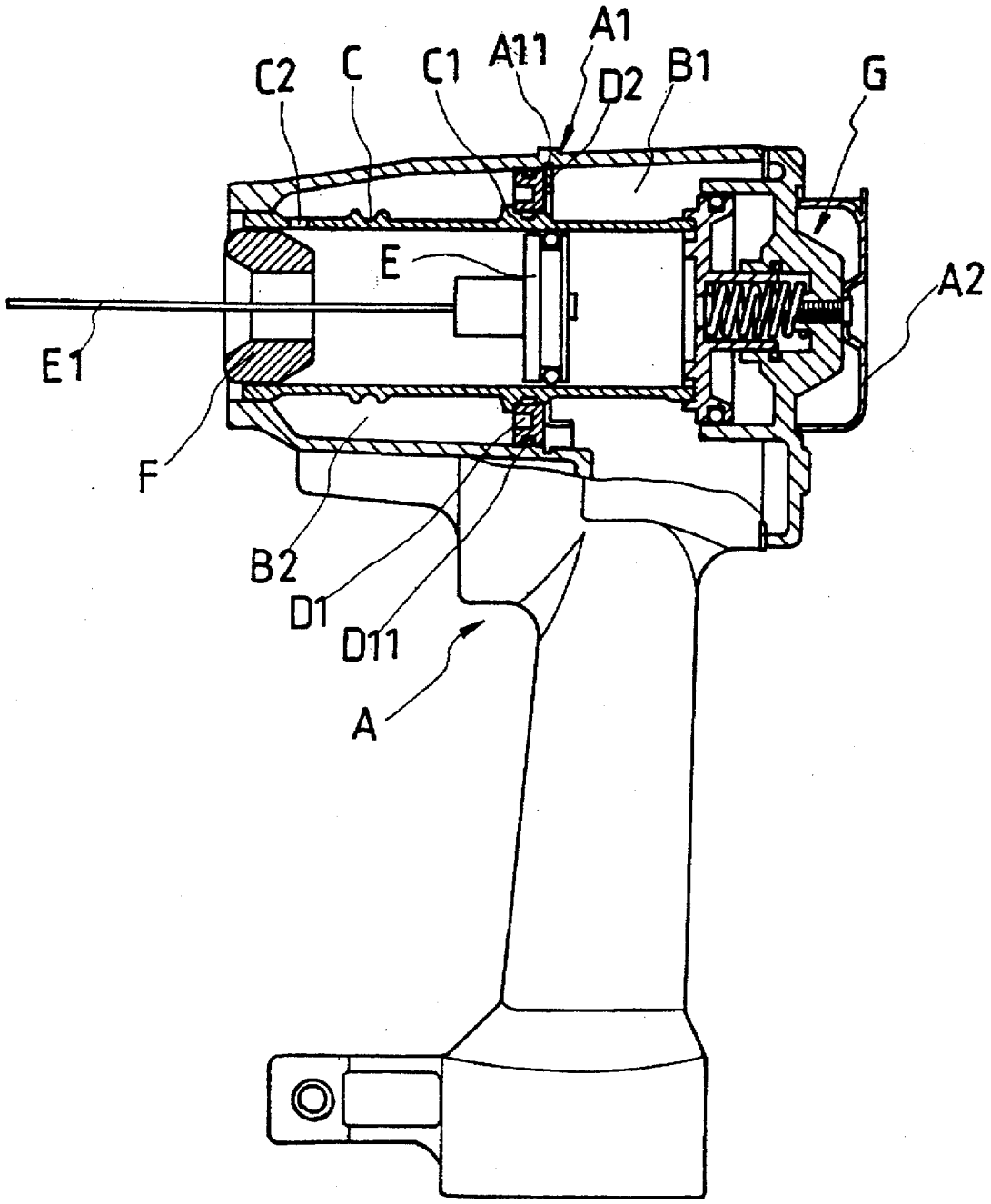
FIG.1 Prior Art
FIG. 1 is a schematic view of the prior art.
Figure 2:
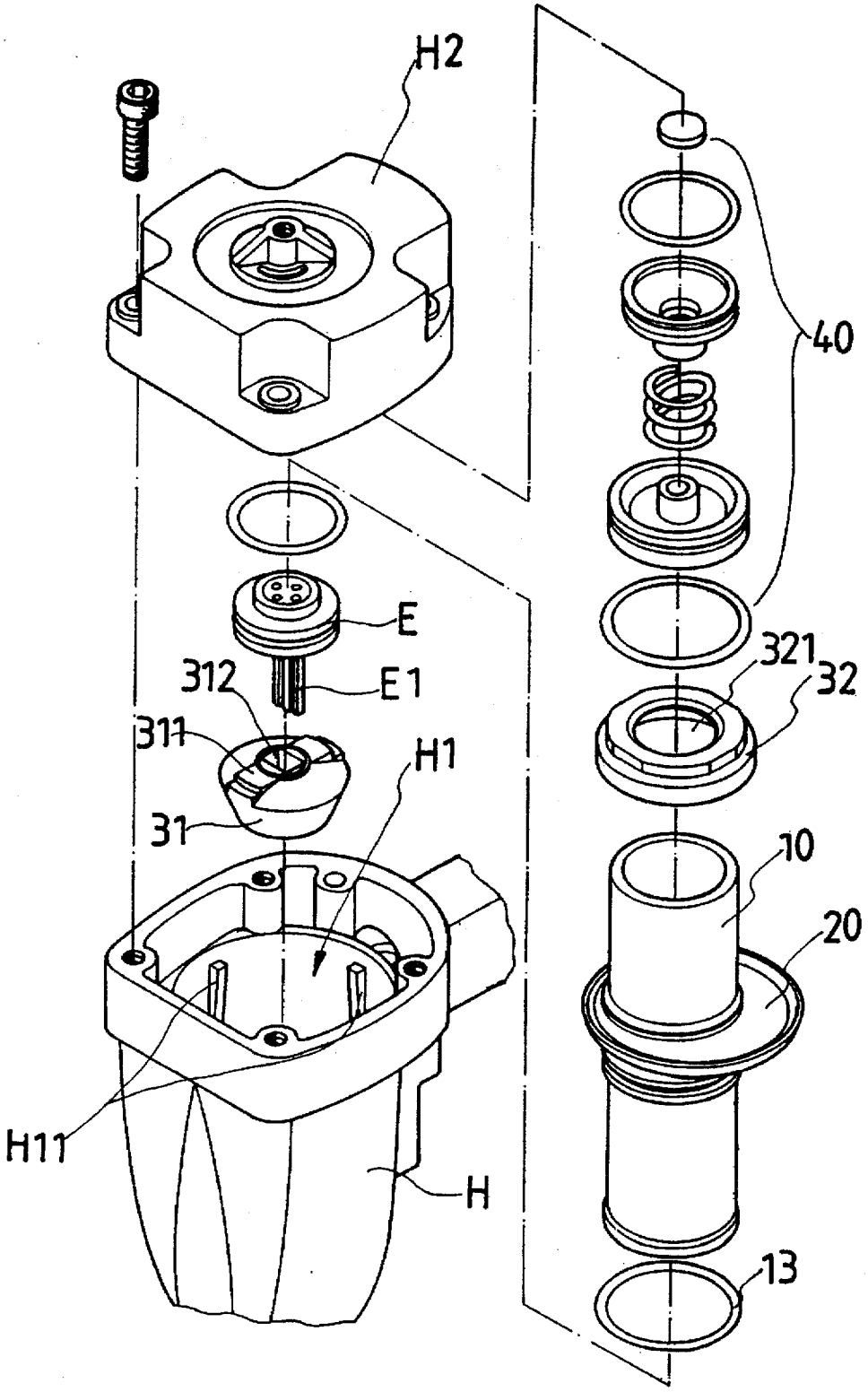
FIG. 2 is an exploded view of a preferred embodiment of the present invention.

In actual assembly, referring to FIGS. 2 and 3, the cylinder 10 is fitted with the O-ring 13 and the plastic sleeve 20. Firstly, the buffer 31 is fitted to a front end of the lower air chamber B2 for sealing an opening of the lower air chamber B2. The piston rod E is then fitted into the cylinder 10 which is fitted onto the buffer 31 so that a strike pin E1 of the piston rod E passes through a central through hole 312 of the buffer 31 and the bottom side of the cylinder 10 just rests on a rib 311 on an upper surface of the buffer 31, defining a clearance between the upper surface of the buffer 31 and the bottom side of the cylinder 10 for passage of compressed air inside the lower air chamber B2 into the interior of the cylinder 10. At this point, the plastic sleeve 20 around the cylinder 10 will press against the upper surfaces of a plurality of ribs H11 extending along an inner wall of the air chamber H1 such that, due to the softness of the plastic body 22, the plastic sleeve 20 may adhere tightly onto the inner wall of the air chamber H1, firmly securing the cylinder 10 within the air chamber H1 and separating the air chamber H1 into an upper air chamber B1 and the lower air chamber B2. After the cylinder 10 is positioned in the air chamber H1, the press element 32 is fitted onto the top end of the cylinder 10. The press element 32 is provided with an opening 321 in an upper side thereof for communicating with an opening of the cylinder 10. The guide means 40 is squeezed into a top cover H2 which is mounted onto a staple gun body H and locked therewith, so that the cylinder 10 may be tightly positioned.

In summary, the present invention utilizes the plastic sleeve formed by the plastic body and the metal plate to replace the conventional sleeve so that the plastic sleeve may fit onto the cylinder as an integral whole. Furthermore, the plastic sleeve may adhere tightly to the inner wall of the air chamber to firmly secure the cylinder disposed therein and to separate the interior into the upper and lower air chambers. In view of the above, the present invention is easy to construct and assemble to facilitate repair and maintenance and allows the cylinder to be firmly positioned. Although the present invention has been illustrated and described with reference to the preferred embodiment thereof, it should be understood that it is in no way limited to the details of such embodiment but is capable of numerous modifications within the scope of the appended claims.

What is claimed is:

1. A mounting structure for a staple gun, comprising:

a gun body having an air chamber defined therein;

a cylinder disposed in said air chamber, said cylinder being fitted with an O-ring and having two spaced flanged rings extending from an outer periphery thereof;

a buffer disposed at an end of said air chamber defined in said gun body, said cylinder accommodating a piston rod and said cylinder engaging said buffer so that a strike pin of said piston rod passes through a central hole defined in said buffer and a bottom side of said cylinder rests upon a plurality of ribs on an upper side of said buffer, said upper side of said buffer and said bottom side of said cylinder defining a clearance for passage of air inside said air chamber into said cylinder;

a sleeve engaged with said cylinder, said sleeve being disposed between said two spaced flanged rings and secured from axial movement thereby, said sleeve pressing against a plurality of ribs extending along an inner wall of said gun body such that said sleeve engages said inner wall of said gun body and firmly positions said cylinder inside said air chamber, said sleeve dividing said air chamber into an upper air chamber and a lower air chamber;

a press element being engaged with a top end of said cylinder, said press element being provided with an opening which communicates with an interior of said cylinder; and a guide means disposed in a top cover of said gun body, wherein said cylinder is provided with two raised rings spaced apart from each other and disposed below said flanged rings, at least one of said raised rings being provided with a plurality of air vents, said O-ring being fitted between said raised rings for covering said air vents for providing an unidirectional supply of air to said lower air chamber during return strokes of said piston rod.

2. The mounting structure for a staple gun defined by claim 1, wherein:

said sleeve comprises a metal plate and a plastic body, said metal plate having a ring opening defined therethrough for receiving said cylinder and said metal plate having a notch defined therein, a portion of said plastic body being received in said notch to preclude movement of said plastic body relative to said metal plate.

3. The mounting structure for a staple gun defined by claim 2 wherein:

an outermost edge of said metal plate of said sleeve is at least partially covered by said plastic body.

* * * * *